US006491264B1

(12) United States Patent
Valesquez

(10) Patent No.: US 6,491,264 B1
(45) Date of Patent: Dec. 10, 2002

(54) BAG SUPPORT ASSEMBLY

(76) Inventor: Raymond Valesquez, P.O. Box 1043, Ulysses, KS (US) 67880

( * ) Notice: Subject to any disclaimer, the term of this patent is extended or adjusted under 35 U.S.C. 154(b) by 0 days.

(21) Appl. No.: 09/625,120

(22) Filed: Jul. 25, 2000

(51) Int. Cl.[7] ..... A63B 55/04
(52) U.S. Cl. ..... 248/97; 248/97
(58) Field of Search ..... 248/95–101, 165, 248/166; 108/116; 211/195; 182/178.1, 178.5

(56) References Cited

U.S. PATENT DOCUMENTS

| | | | | | |
|---|---|---|---|---|---|
| 4,251,044 | A | * | 2/1981 | Olson | |
| 4,537,376 | A | * | 8/1985 | Buku | |
| 4,562,983 | A | * | 1/1986 | Klefbeck | 248/97 |
| 5,016,844 | A | * | 5/1991 | Garvir | 248/97 |
| 5,016,893 | A | * | 5/1991 | Hart | |
| 5,042,614 | A | * | 8/1991 | Rainey | 182/178.1 |
| 5,193,770 | A | * | 3/1993 | Kildare | 248/97 |
| 5,213,291 | A | * | 5/1993 | Wuiebe | 248/97 |
| 5,439,152 | A | * | 8/1995 | Campbell | |
| 5,738,314 | A | * | 4/1998 | Davis | 248/97 |
| 5,868,364 | A | * | 2/1999 | MacMillan | 248/97 |
| 6,076,782 | A | * | 6/2000 | Alderman | 248/97 |

FOREIGN PATENT DOCUMENTS

| | | | | |
|---|---|---|---|---|
| FR | 2529931 | * | 1/1984 | 182/224 |

* cited by examiner

*Primary Examiner*—Alvin Chin-Shue
(74) *Attorney, Agent, or Firm*—Kenneth H. Jack; Davis & Jack, L.L.C.

(57) ABSTRACT

A bag support assembly (1) consisting of an upper frame (2); first and second legs (10) and (16), hinge sleeves (6) and (8) respectively interconnecting the upper frame (2) and the first and second legs (10) and (16) so that such legs may pivotally move between first and second positions, such legs folding beneath the upper frame (2) while in their first positions, such legs extending downwardly from the upper frame (2) while in their second positions; first and second leg extensions (18) and (22); and slip joints (26) alternately attaching in a first configuration or a second configuration the first and second leg extensions (18) and (22) to the first and second legs (10) and (16), the first and second leg extensions (18) and (22) spanning between and extending downwardly from the first and second legs (10) and (16) while attached in the first configuration, forming a rigid bag support frame, the first and second leg extensions (18) and (22) respectively extending downwardly from the first and second legs (10) and (16) while attached in the second configuration, forming a height adjustable bag support frame.

3 Claims, 6 Drawing Sheets

BAG SUPPORT ASSEMBLY

FIELD OF THE INVENTION

This invention relates to apparatus adapted for supporting and opening for convenient use plastic lawn and leaf bags or laundry bags.

BACKGROUND OF THE INVENTION

Holders for flexible laundry bags, trash bags, or grass and leaf bags which are configured as a rigid box frame are known. Examples of such bag holders are disclosed in U.S. Pat. Nos. 4,157,801; 4,273,167; 4,442,567; 4,537,376; 4,708,246; 4,759,518; 4,901,959; 5,154,359; 5,924,657; 6,007,030; D308,271; and D399,623; issued respectively to Elmer; Stillwell; Pravettone; Bucku; Wolf; Yardas; Stage; Junta, et al.; Bach; Judge; Vreeken; and Kearney. A common drawback or deficiency of such rigid frame bag supports is that they are incapable of being alternately configured for height adjustability. The lack of a height adjustability feature frequently leads to situations where the floor of a bag held by such bag holders is left unsupported, allowing heavy articles within the bag to either tear the bag or pull the bag away from the holder. The instant inventive bag holder overcomes such drawbacks or deficiency by providing a novel bag support structure allowing the inventive bag holder to be alternately configured as a rigid box frame, and in a leg splaying configuration for height adjustability.

BRIEF SUMMARY OF THE INVENTION

The instant inventive bag holder comprises an alternately configurable assembly whose chief components comprise an upper frame, first and second legs pivotally attached to the upper frame, and first and second leg extensions removably attachable in alternate configurations to the lower ends of the legs. Preferably, the upper frame of the assembly is slightly oblongated, cumulative peripheral dimensions allowing the upper frame to support the openings of common 33 gallon or 38 gallon plastic lawn and leaf bags. Preferably, the upper frame is from a length of outwardly opening "C" channel steel so that an elastic cord annularly situated within the channel may secure therearound plastic gags or fabric laundry bags. Alternately, the upper frame may comprise a simple bar formed into a rectangular loop. Where no outwardly opening elastic cord receiving channel is presented by the upper frame, bags are preferably secured thereto by means of clips.

Preferably, pivotal attaching means interconnect the legs with the lower surface of the upper frame at opposing ends of the upper frame, such opposing ends preferably being the short ends of the rectangle. Also, preferably, each leg has a width which allows it to co-extensively underlie the frame end to which it is attached. While a preferred pivotal attaching means comprises a simple sleeve hinge having a flat upper bearing surface for secure welding to the lower surface of the upper frame, numerous other pivotal attaching means such as cylindrical collar hinges, leaf hinges, pin and device hinges, pin and eye hinges, flexible sheet hinges, gear hinges, butt hinges, strap hinges, "T" hinges, slip joint hinges, and spring hinges may be suitably utilized.

In a preferred embodiment of the invention, each leg is fabricated from ¼" to ⅜" steel bar stock, configured as a downturned "U", whose upper cross member (i.e., the base of the "U") serves as a hinge pin extending through the preferred hinge sleeves. Preferably, the lengths of the legs are fitted so that they may pivotally move between first and second positions, the legs folding beneath the upper frame upon pivotal movement to their first positions, the legs extending downwardly from the upper frame upon opposite pivotal movement to their second positions. Where the legs are configured as a downturned "U", it is preferable that each have a horizontal cross-brace for enhanced structural rigidity. Alternately, structural rigidity may be achieved by configuring the legs as panels.

The first and second leg extensions are preferably alternately attachable to the lower ends of the first and second legs by removable attaching means, the alternate attachments allowing a first and a second configuration of the bag support assembly. Where the first and second leg extensions are attached to the lower ends of the first and second legs in the first configuration, the first and second leg extensions span between the first and second legs while extending downwardly therefrom. Such first configuration beneficially forms a rigid box frame for bag support. Where the first and second leg extensions are attached to the lower ends of the first and second legs in the second configuration, such leg extensions respectively independently extend from the first and second legs, allowing them to continue to move pivotally with respect to the upper frame. Such second configuration allows the legs and leg extensions to be pivotally splayed at various angles with respect to the ground, allowing height adjustment of the upper frame.

A preferred removable attaching means for attaching the leg extensions to the legs comprises upwardly opening or downwardly opening slip joints, the slip joints, when upwardly opening being fixedly attached to the upper ends of the leg extensions, the slip joints, when downwardly open, being fixedly attached to the lower ends of the legs. Other removable attaching means which may suitably be utilized for attaching the leg extensions to the legs are threaded rotatable couplings, eye and shear pin joints, snap fasteners, and plate mounts. Preferably, the leg extensions are fabricated from ¼" to ⅜" steel bar stock welded in an "H" configuration. Preferably, a second crossbar is provided for additional structural rigidity. Alternately, structural rigidity of the leg extensions may be enhanced by configuring the leg extensions as panels.

In operation of the inventive bag holder assembly, the leg extensions may be attached to configure the holder either as a rigid box frame, or with legs splayed at a selected angle raising the upper frame to a desire height. Where the bag holder is configured as a rigid box frame, the holder may simply rest upon a hard surface. Alternately, the lower ends of the leg extensions may be driven into soft ground surfaces, preventing the holder from overturning in strong wind. Where it is desirable to allow the ground to support the floor of a short bag while filling such bag with heavy leaves or grass, the second configuration is utilized. In the second configuration, outward splaying of the legs and independently attached leg extension allows such bag to be lowered until the floor of the box rests upon the ground. In the second configuration, the lower ends of the leg extensions may similarly be driven into the ground, providing stability to the bag holder.

When the inventive bag holder assembly is not in use, it may be conveniently disassembled, folded and stacked in a small storage container.

Accordingly, it is an object of the present invention to provide a bag holder assembly which is alternately configurable as a rigid box frame or a height adjustable leg splaying frame.

It is a further object of the present invention to provide such a bag holder which may be compactly folded and stored when not in use.

Other and further objects, benefits, and advantages of the present invention will become known to those skilled in the art upon review of the Detailed Description which follows, and upon review of the appended drawings.

DETAILED DESCRIPTION OF THE PREFERRED EMBODIMENT

Figure 1:
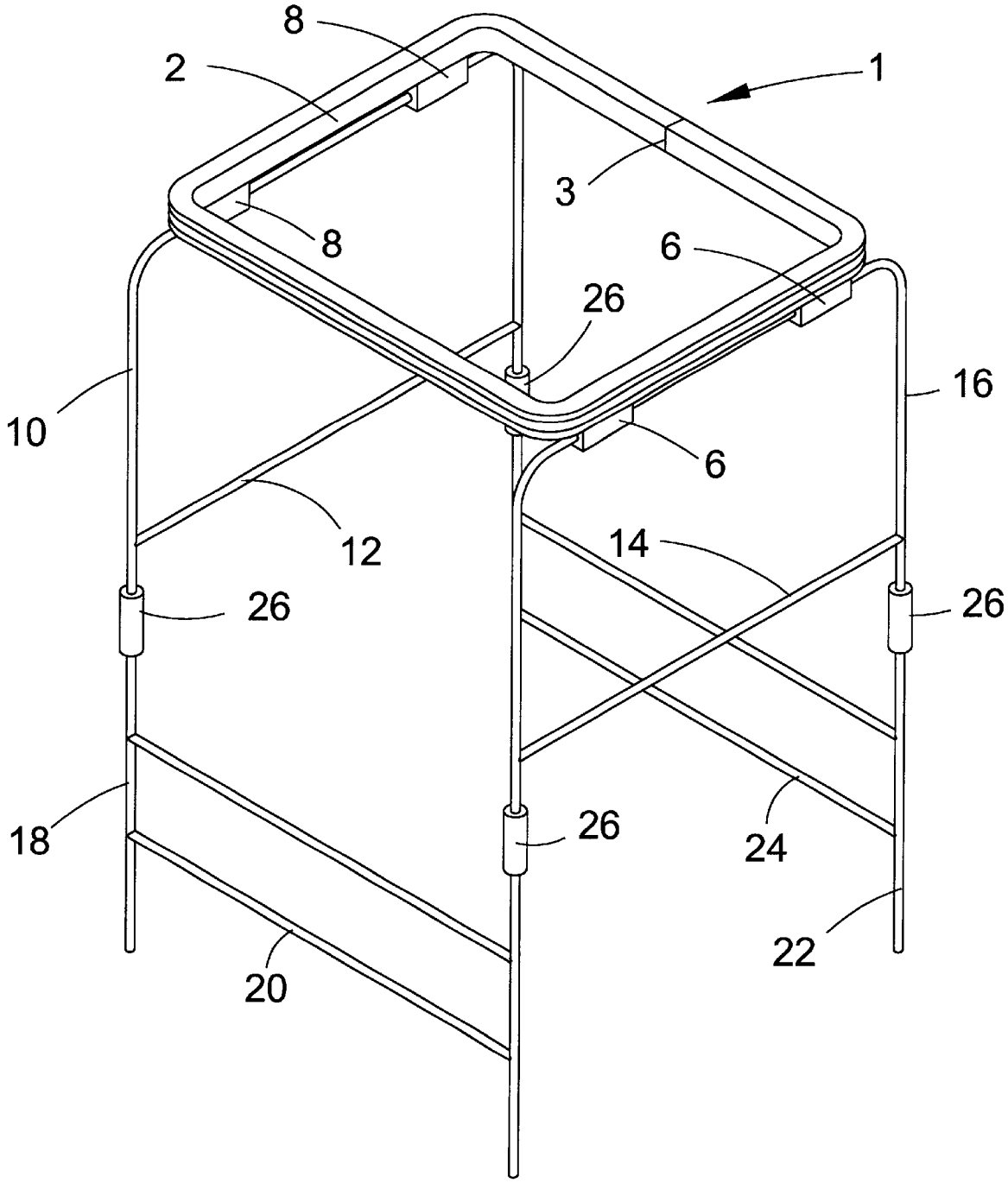
FIG. 1 is an isometric view of the inventive bag holder assembly shown configured as a box frame.
Figure 2:
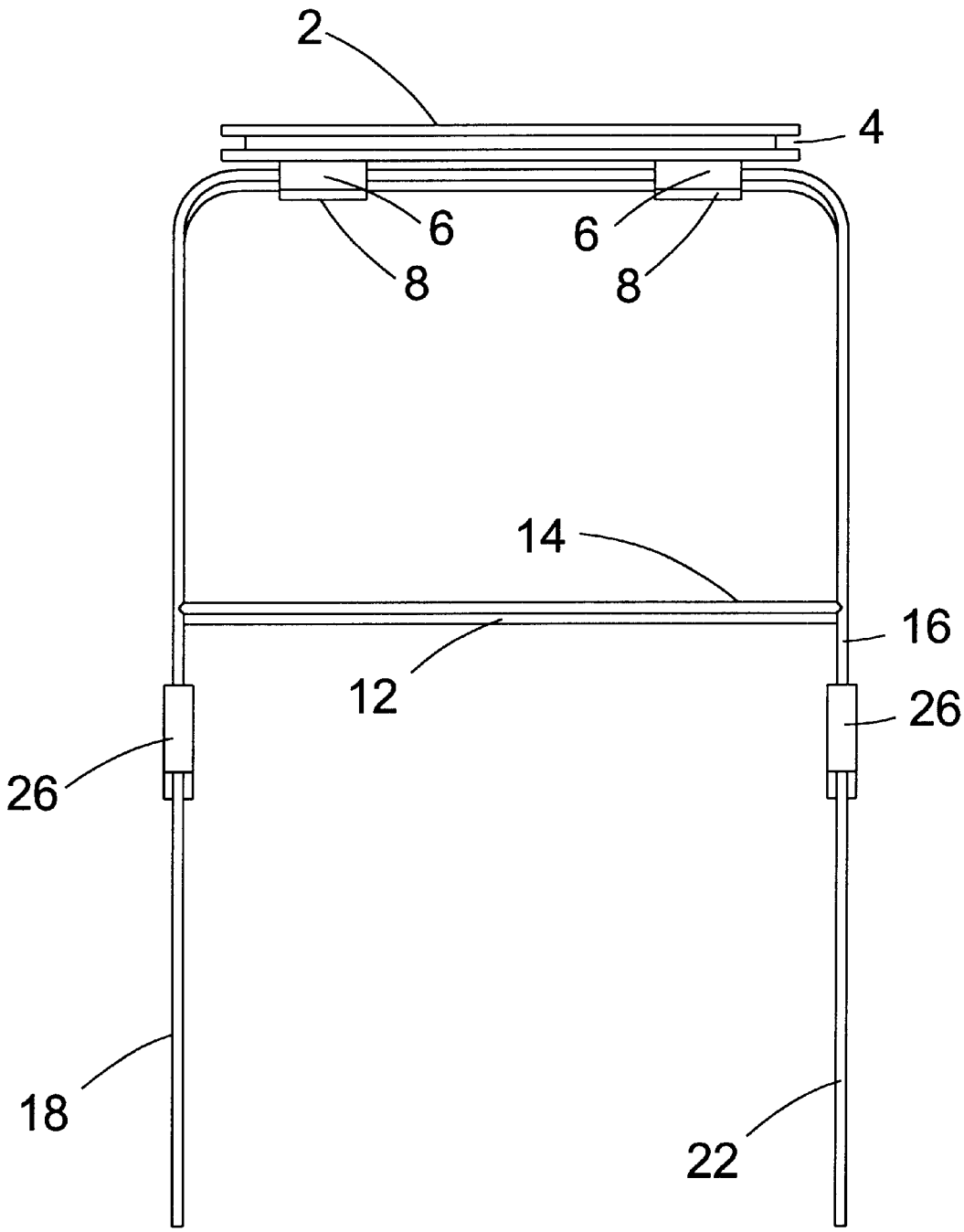
FIG. 2 is a side view of the assembly depicted in FIG. 1.

Referring now to the drawings, and in particular to FIG. 1, the inventive bag holder assembly is referred to generally by reference arrow 1. Upper frame 2 preferably is rectangular and, referring simultaneously to FIGS. 1 and 2, is preferably fabricated from a rolled "C" channel steel beam, providing an elastic band receiving channel 4. Referring again to FIG. 1, the ends of the upper frame 2 are preferably welded at a seam 3, forming a rigid hoop.

Figure 3:
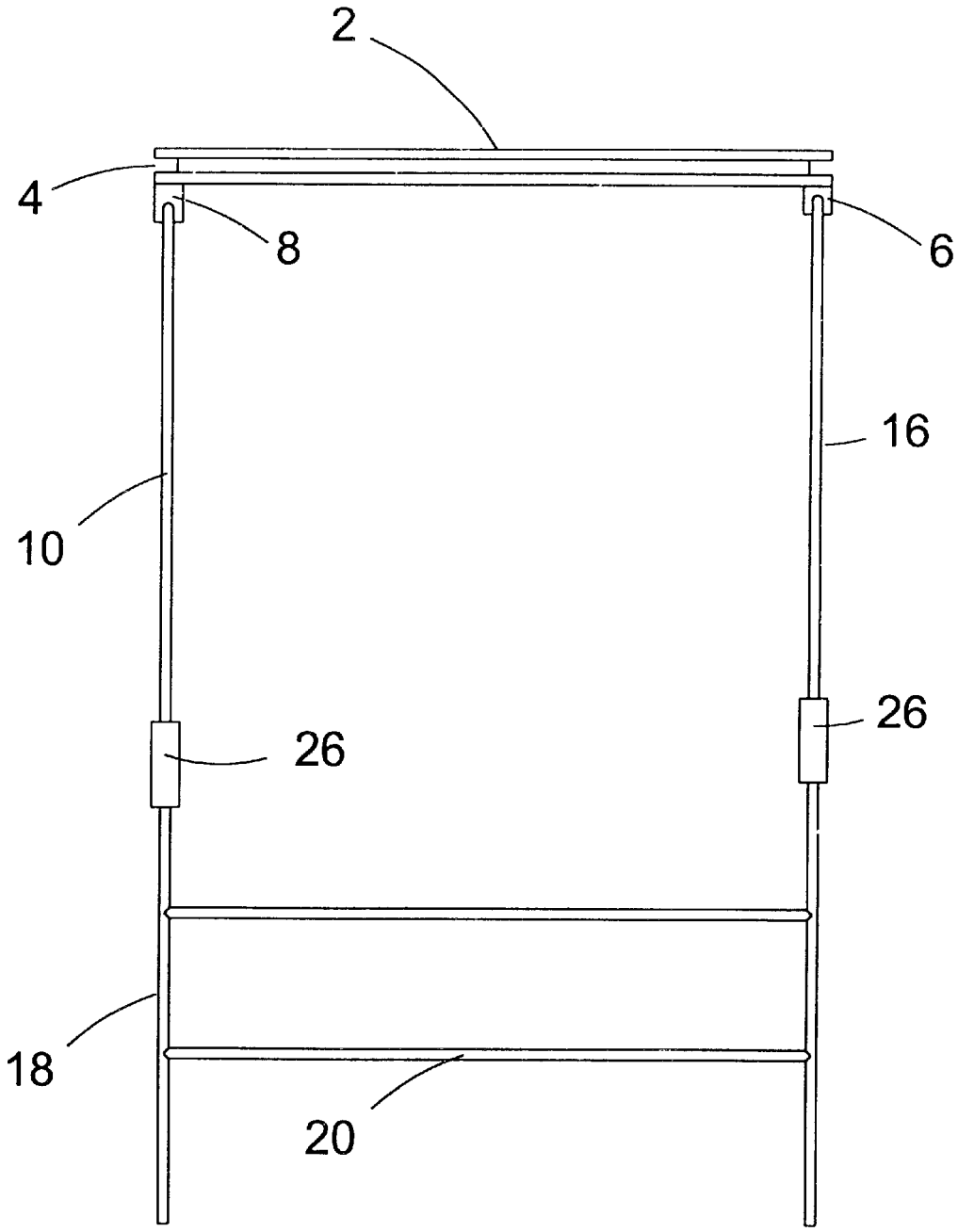
FIG. 3 is an alternate side view of the assembly depicted in FIG. 1.

Referring further to FIG. 1, legs 10 and 16, preferably fabricated from steel bar stock in the shape of a downturned "U", are pivotally mounted upon the undersurface of the upper frame 2 by means of hinge sleeves 6 and 8. The horizontal upper sections of legs 10 and 16 (i.e., the base of the "U") preferably extend through hinge sleeves 6 and 8, simultaneously acting as structural components of the legs and as hinge pins. Referring simultaneously to FIGS. 1 and 3, it is preferable that hinge sleeves 8 downwardly extend the upper horizontal section of leg 10 below that of leg 16 so that leg 16 may be inwardly folded beneath upper frame 2, allowing leg 10 to be successively inwardly fold beneath leg 16, without binding. Such inward folding of legs 10 and 16 accommodates compact storage of the assembly 1 when not in use.

While the hinge sleeves 6 and 8 in combination with legs 10 and 16 acting as hinge pine comprise a preferred pivotal attaching means, numerous other pivotal attaching means such as leaf hinges, pin and device hinges, pin and eye hinges, flexible sheet hinges, gear hinges, butt hinges, strap hinges, "T" hinges, slip joint hinges, and spring hinges (all not depicted) may be suitably utilized.

For additional structural rigidity of legs 10 and 16, it is preferable that crossbars 12 and 14 respectively span between the vertical sections of legs and 10 and 16. Suitably, other means of enhancing the structural rigidity to legs 10 and 16 may be utilized, such as configuring such legs as pivotally attached panels (not depicted).

Figure 4:
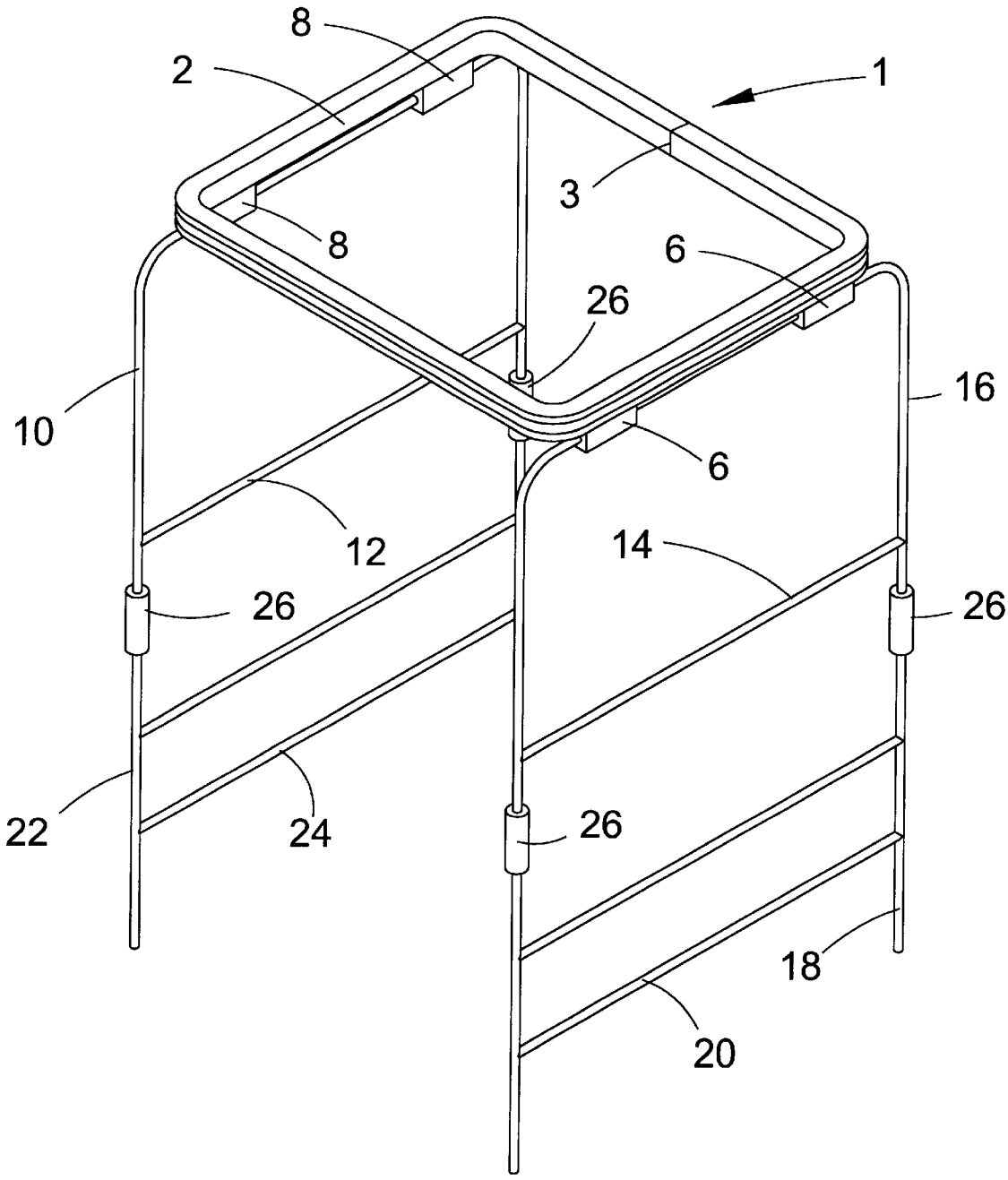
FIG. 4 is an isometric view of the inventive bag holder assembly shown configured as a leg splaying height adjustable bag support.
Figure 5:
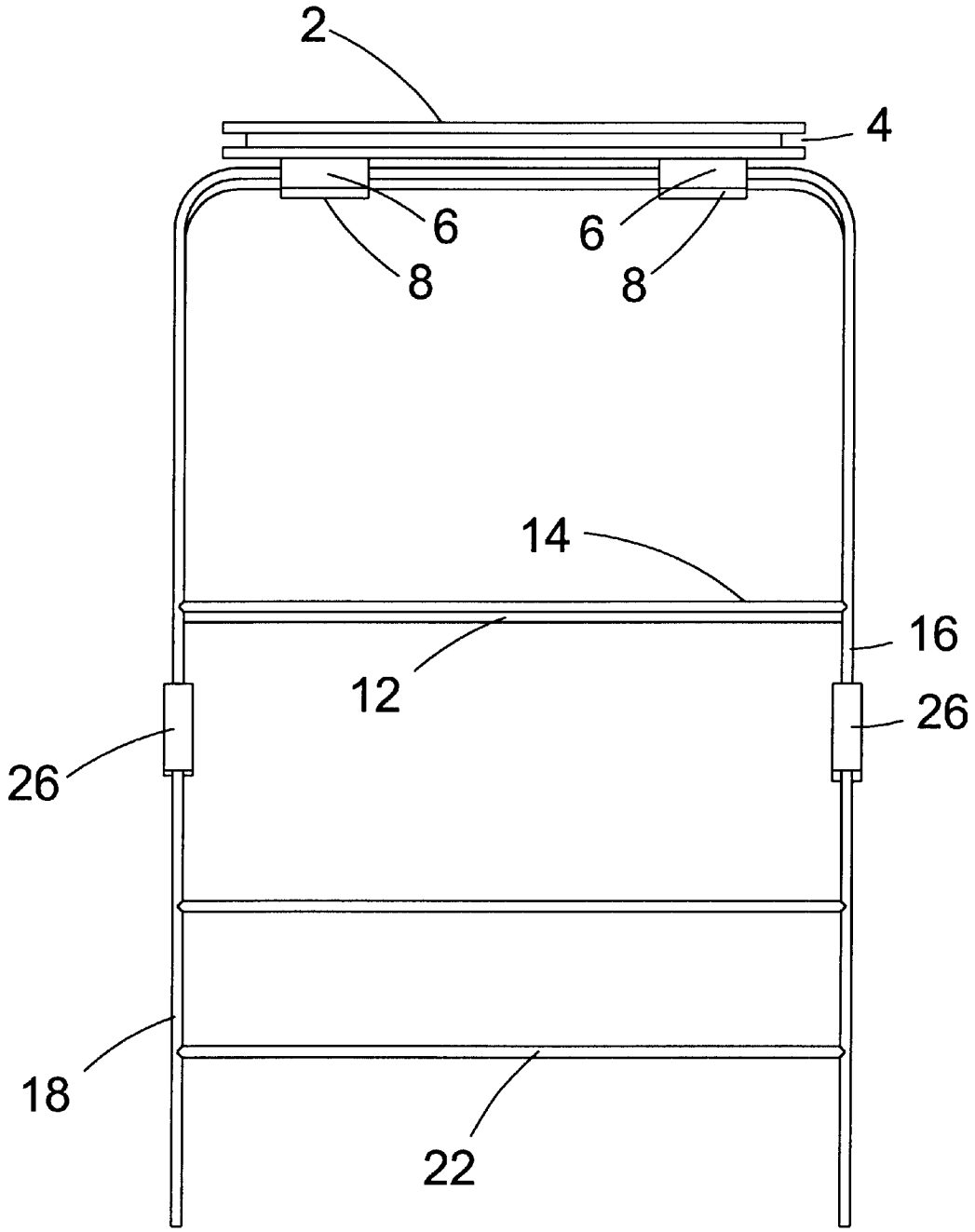
FIG. 5 is a side view of the assembly depicted in FIG. 4.

Referring simultaneously to FIGS. 1 and 4, leg extensions 18 and 22, each having an "H" configuration are alternately removably attached to the lower ends of legs 10 and 16, the alternate attachments allowing a first and a second configuration of the bag holder assembly. Preferably, leg extensions 18 and 22 are fabricated from ¼" to ⅜" steel bar stock. FIG. 1 depicts attachment of leg extensions 18 and 22 in the first configuration, and FIG. 4 depicting attachment of such legs in the second configuration. While the leg extensions 18 and 22 are attached in the first configuration depicted in FIG. 1, the bag support assembly 1 comprises a substantially rigid box frame. Where the leg extensions 18 and 22 are attached in the second configuration depicted in FIG. 4, legs 10 and 16 remain free to pivot or splay outwardly, providing height adjustability to upper frame 2.

Further referring to FIGS. 1 and 4, removable attaching means, preferably slip joints 26, connect the lower ends of legs 10 and 16 and the upper ends of leg extensions 18 and 22. Such slip joints may be alternately fixedly attached to the lower ends of legs 10 and 16 or to the upper ends of leg extensions 18 and 22; the slip joints opening downwardly when attached to the legs, and opening upwardly when attached to the leg extensions. Other removable attaching means such as threaded rotatable couplings, eye and shear pin joints, snap fasteners, and plate mounts (all not depicted) may be suitably utilized for connecting the leg extensions 18 and 22 to legs 10 and 16.

Referring to FIG. 4, crossbars 20 and 24 preferably span between the vertical members of legs 18 and 22 providing structural rigidity. An alternate suitable means for enhancing the structural rigidity to leg extensions 18 and 22 is to configure such leg extensions as panels (not depicted).

In use of the inventive bag support assembly, referring to FIG. 1, leg extensions 18 and 22 may be attached to legs 10 and 16 so that they span therebetween and extend downwardly therefrom, configuring the inventive assembly 1 as a rigid box frame. With the bag support assembly 1 so configured, a plastic or fabric bag may thereby be supported in conventional fashion, using, referring to FIG. 6, a flexible band 30 to secure material at the opening of such bag within channel 4. Referring further to FIG. 1, where the bag support assembly 1 rests upon loose soil or grass, downward foot pressure may be applied to crossbars 20 and 24 driving the lower ends of leg extensions 18 and 22 into the ground, providing additional support to the bag support assembly 1.

Figure 6:
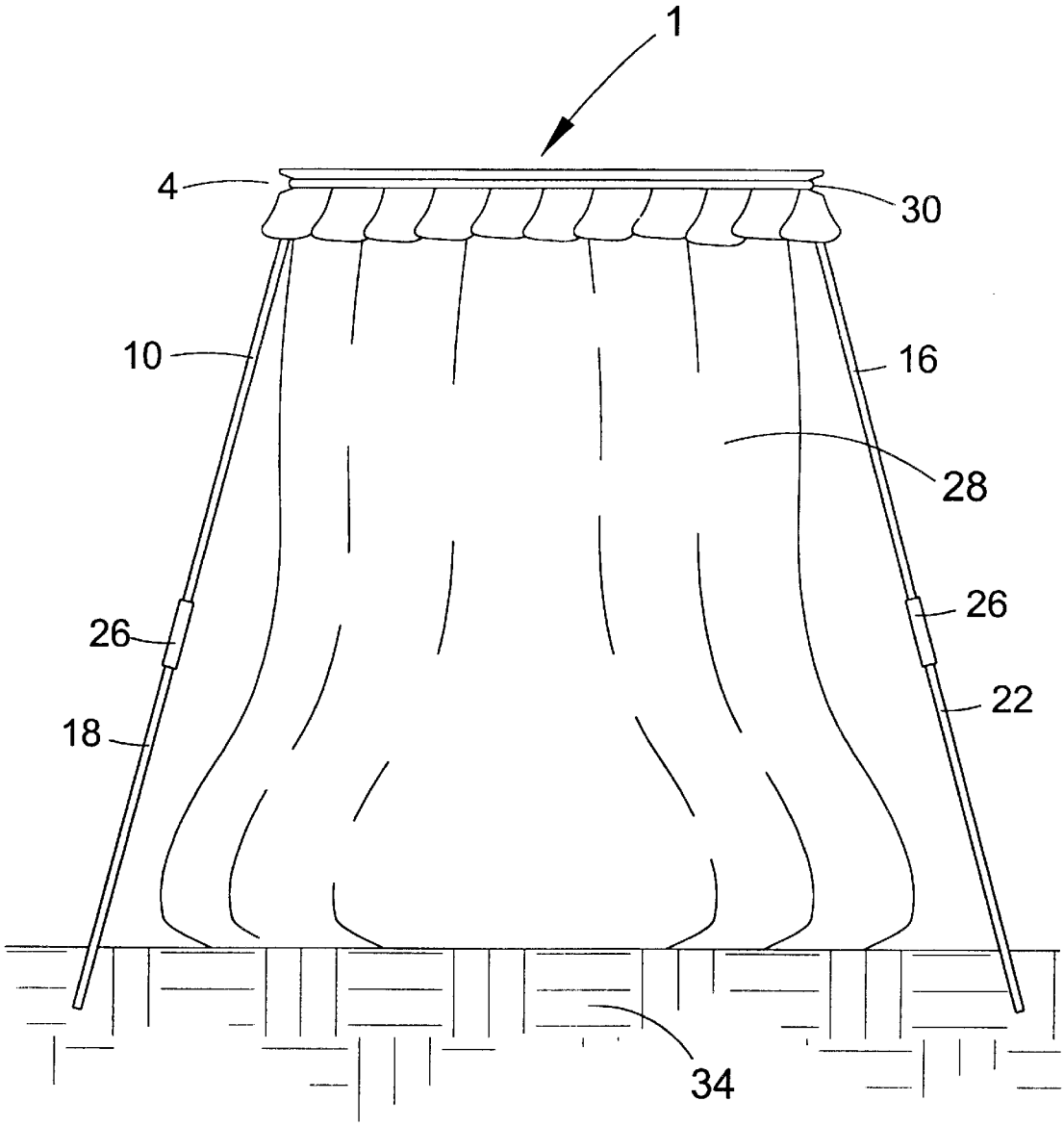
FIG. 6 is a side view of the inventive assembly shown in use in its leg splaying configuration.

Alternately, referring to FIGS. 4 and 6, leg extensions 18 and 22 may be configured so that they respectively and independently extend downwardly from legs 16 and 10, leaving such legs and leg extensions free to pivot or splay outwardly. As depicted in FIG. 6, outward pivotal splaying of legs 10 and 16 in unison with leg extensions 18 and 22 lowers the upper frame 2 to a desired height, allowing the lower end of a bag 28 to rest upon and be supported by the ground 34. In order to provide additional support to the assembly, foot pressure may be downwardly applied to crossbars 20 and 24, driving the lower ends of leg extensions 18 and 22 into the ground.

Further referring simultaneously to FIGS. 4 and 6, in order to store the inventive bag support assembly, elastic cord 30 is removed, and bag 28 is removed. Elastic cord 30 may then be conveniently stored, annularly lying within channel 4. An upward pulling motion is then applied to upper frame 2, pulling the lower ends of legs 10 and 16 away from the upper ends of leg extensions 18 and 22. Thereafter, in sequence, leg 16 is pivotally folded inwardly to underlie upper frame 2, and leg 10 is pivotally folded inwardly to underlie leg 16. Leg extensions 18 and 22 are then removed from the ground and stacked upon the upper surface of upper frame 2, or below the folded legs. While the inventive bag support assembly is so folded and stacked, it may be conveniently tied in a substantially flat rectangular configuration, and stored in a compact box or bag for future use.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A bag support assembly comprising:

(a) an upper frame defining a bag receiving space, said frame having a lower surface, a first end, and a second end;

(b) first and second legs, (c) pivotal attaching means, wherein the pivotal attaching means comprises hinges fixedly attached to the lower surface of the upper frame the pivotal attaching means respectively interconnecting the first and second ends of the upper frame and the first and second legs so that such legs may pivotally move between first and second positions, such legs folding beneath the upper frame while in their first positions, such legs extending downwardly from the upper frame while in their second positions the first and second legs each comprising a pair of rigidly interconnected leg members, each leg member having a lower end;

(d) first and second leg extensions, each having a pair of rigidly interconnected extension leg members with upper ends; and, (e) removable attaching means alternately attaching in a first configuration and in a second configuration the upper ends of the first and second leg extensions to the lower ends of the first and second legs, in the first configuration the upper ends of the first leg extension are connected to one of the lower ends of one of the first leg member and one of the second leg member, and the upper ends of the second leg extension are connected to the lower ends of the other of the first leg member and the other of the second leg member, the first and second leg extensions rigidly interconnecting the first and second legs to form a rigid bag support frame, in the second configuration the upper ends of the first leg extension are connected to the lower ends of the first leg members, and the upper ends of the second leg extension are connected to lower ends of the second leg members, wherein the first and second legs and the connected extensions form a bag support frame having splayable legs, the height of such frame being adjustable by splaying of the first and second legs.

2. The assembly of claim 1 wherein the upper frame comprises an outwardly opening channel.

3. The assembly of claim 1 wherein the upper frame, the first and second legs, and the first and second leg extensions are composed of a material comprising steel.

* * * * *

UNITED STATES PATENT AND TRADEMARK OFFICE

CERTIFICATE OF CORRECTION

PATENT NO. : 6,491,264 B1
DATED : December 10, 2002
INVENTOR(S) : Velasquez

It is certified that error appears in the above-identified patent and that said Letters Patent is hereby corrected as shown below:

Title page,
Item [76], Inventor, "Valesquez" should read -- Velasquez --

Signed and Sealed this

Fifteenth Day of July, 2003

JAMES E. ROGAN
*Director of the United States Patent and Trademark Office*